US009546855B2

(12) United States Patent
Higham et al.

(10) Patent No.: US 9,546,855 B2
(45) Date of Patent: Jan. 17, 2017

(54) LINE DELIVERY APPARATUS

(71) Applicant: LINE LAUNCHER HOLDINGS LIMITED, Auckland (NZ)

(72) Inventors: Anthony John Higham, Auckland (NZ); Kurt Laurence Scholz, Auckland (NZ)

(73) Assignee: LINE LAUNCHER HOLDINGS LIMITED, Auckland (NZ)

( * ) Notice: Subject to any disclaimer, the term of this patent is extended or adjusted under 35 U.S.C. 154(b) by 136 days.

(21) Appl. No.: 14/404,553

(22) PCT Filed: May 30, 2013

(86) PCT No.: PCT/NZ2013/000090

§ 371 (c)(1),
(2) Date: Nov. 28, 2014

(87) PCT Pub. No.: WO2013/180579

PCT Pub. Date: Dec. 5, 2013

(65) Prior Publication Data

US 2015/0168115 A1 Jun. 18, 2015

(30) Foreign Application Priority Data

May 30, 2012 (NZ) ..... 600319

(51) Int. Cl.
*B64D 1/04* (2006.01)
*F42B 12/68* (2006.01)
(Continued)

(52) U.S. Cl.
CPC ..... *F42B 12/68* (2013.01); *B63C 9/26* (2013.01); *F41B 11/62* (2013.01); *F41B 11/723* (2013.01)

(58) Field of Classification Search
USPC ..... 89/1.34, 1.3, 7; 124/70, 71, 73, 74, 75
See application file for complete search history.

(56) References Cited

U.S. PATENT DOCUMENTS 4,332,234 A 6/1982 Allen
5,450,839 A 9/1995 Nicolaevich et al.
(Continued)

FOREIGN PATENT DOCUMENTS

CN 201678033 12/2010
CN 202074883 12/2011
(Continued)

OTHER PUBLICATIONS

International Search Report, PCT/NZ2013/000090, Sep. 24, 2013.
(Continued)

*Primary Examiner* — J. Woodrow Eldred
(74) *Attorney, Agent, or Firm* — Young & Thompson

(57) ABSTRACT

A line launcher (110) capable of firing a projectile (117) and an attached line (125) up to about 70 meters. It has a barrel (113) large enough for a resilient projectile attached to a line. It has a pre-charge chamber capable of storing a pressurized gas from a pressurized gas cartridge. A trigger mechanism vents the gases in this pre-charge chamber into the barrel to expel the projectile and line. Gas from the pressurized gas cartridge (e.g. a $CO_2$ bulb) is released slowly enough to pressurize the pre-charge chamber but without the cartridge freezing as might occur if the gas was discharged directly from the cartridge into the barrel to directly propel the projectile.

16 Claims, 12 Drawing Sheets

Figure 1:
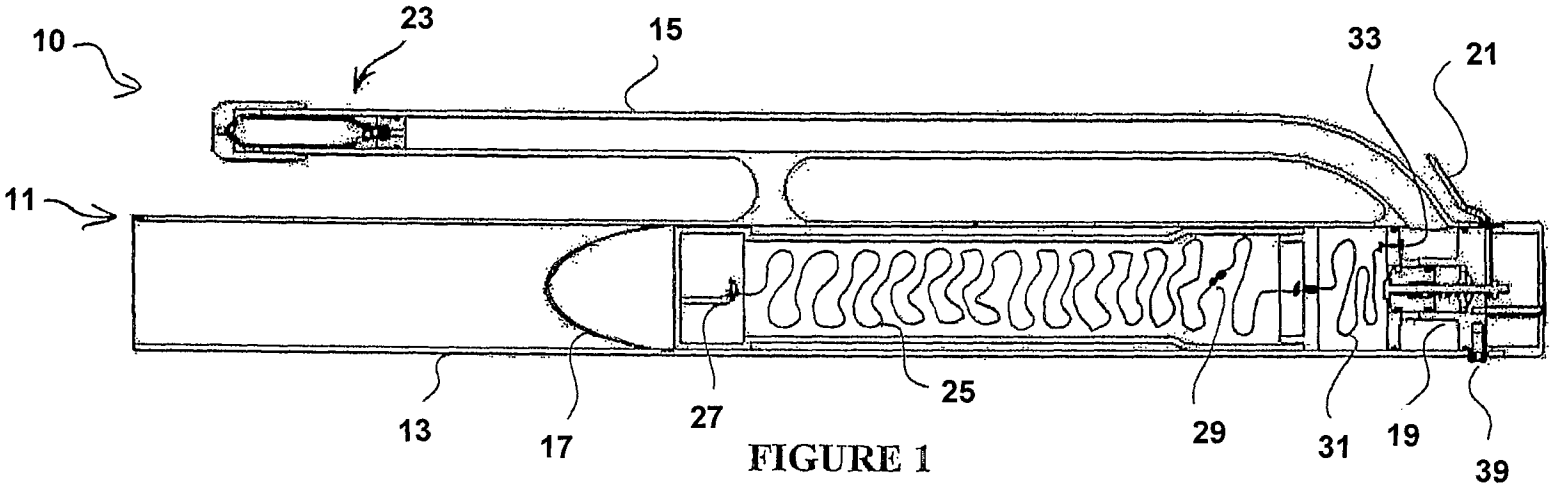

(51) Int. Cl.

| | |
|---|---|
| ***B63C 9/26*** | (2006.01) |
| ***F41B 11/62*** | (2013.01) |
| ***F41B 11/723*** | (2013.01) |

(56) References Cited

U.S. PATENT DOCUMENTS

| | | | | |
|---|---|---|---|---|
| 6,244,261 | B1 * | 6/2001 | West, Jr. | F41B 11/62 102/504 |
| 6,843,388 | B1 * | 1/2005 | Hollars | F17C 13/06 222/183 |
| 9,016,267 | B1 * | 4/2015 | Tseng | F42B 10/14 124/71 |
| 2002/0139239 | A1 * | 10/2002 | Vogl | F41A 1/04 89/1.34 |
| 2009/0178329 | A1 | 7/2009 | Jelnicki, Jr. | |

FOREIGN PATENT DOCUMENTS

| | | |
|---|---|---|
| GB | 1166077 | 10/1969 |
| GB | 2105447 | 3/1983 |
| WO | WO 00/76588 | 12/2000 |

OTHER PUBLICATIONS

Australian Examination Report, dated Nov. 4, 2014, in corresponding Australian Patent Application No. 2014100752.
New Zealand Examination Report, dated Jun. 3, 2013, in corresponding New Zealand Patent Application No. 611461.

* cited by examiner

LINE DELIVERY APPARATUS

FIELD OF THE INVENTION

This invention relates to a line delivery apparatus, and in particular, but not exclusively to a line delivery apparatus for use in rescue applications.

BACKGROUND OF THE INVENTION

During rescue operations, particularly at sea, it is often useful to throw a line to a person to assist in rescuing the person. While it is possible to simply throw a line to someone who is close, it can be a problem to throw a line to someone who is more than about 15 meters away. In sea rescue situations it is common to not be able to get any closer than about 20 to 40 meters to a person in difficulty.

For this reason a number of line launchers have been produced. These are devices that have been designed to launch a projectile which will drag out a line behind it. Some devices use self propelled projectiles.

However the presently available line launchers are often quite complex and/or expensive to use. Some use pyrotechnic devices and can require special licensing to own and use. The initial cost, the complexity, the specialised training requirements, the specialised storage requirements, the maintenance requirements, and/or the cost of use, has meant that these devices are often not carried on rescue vehicles.

OBJECT OF THE INVENTION

It is therefore an object of the present invention to provide a line delivery apparatus which will at least go some way towards overcoming the above mentioned problems, or at least provide the public with a useful choice.

STATEMENTS OF THE INVENTION

Accordingly, in a first aspect, the invention may broadly be said to consist in a line delivery apparatus having a pre-charge chamber and a barrel configured to receive and to expel a projectile, the barrel having an open end and a closed end, the pre-charge chamber having one or more inlet ports which communicate with a charging means, and the pre-charge chamber having one or more outlet ports which communicate with the closed end of the barrel, and the apparatus is configured in such a manner that the flow of fluid through the or each outlet port is controlled by a triggering mechanism.

In another aspect the invention provides a line delivery apparatus having a barrel configured to receive and to expel a projectile by use of the expansion of a compressed gas, the barrel having an open end and a closed end, wherein the apparatus includes a pre-charge chamber having one or more inlet ports which communicate with a source of compressed gas, and the pre-charge chamber having one or more outlet ports which communicate with the closed end of the barrel, and the apparatus is configured in such a manner that the flow of fluid through the or each outlet port is controlled by a triggering mechanism.

Preferably the source of compressed gas used to charge the pre-charge chamber is a small single use pressurised fluid cylinder which can be attached to and form part of the apparatus. Such a small cylinder is typically known as a "sparklet bulb" and is used to supply carbon dioxide gas to soda siphons. Being small it is readily portable and be easily attached to the line launcher without requiring an external pipes or hoses and is light enough not to interfere with the portability or aiming of the lien launcher.

Preferably the line delivery apparatus also includes a line which is connectable at one end to the interior of the barrel and at an opposite end to the projectile.

Preferably the line delivery apparatus also includes the projectile.

Preferably the triggering mechanism includes a manually operated trigger.

Preferably the triggering mechanism includes a valve member which is movable between a first position in which the valve member prevents flow through the or each outlet port, and a second position in which the valve member does not prevent flow through the or each outlet port.

Preferably the valve member is moved from the first position to the second position by the pressure of the fluid within the pre-charge chamber when the valve member is allowed to do so by the triggering mechanism.

Preferably the valve member is held at the first position by pressurised fluid held within a trigger mechanism chamber.

Preferably some or all of the pressurised fluid held within the trigger mechanism chamber is released when the manually operated trigger is moved.

Preferably the trigger mechanism chamber is charged with pressurised fluid by the same source used to charge the pre-charge chamber.

Preferably the source used to charge the pre-charge chamber is a pressurised fluid cylinder.

Preferably the line delivery apparatus includes a piercing device configured to pierce a cap of the pressurised fluid cylinder.

Preferably the line delivery apparatus includes a one way valve between the trigger mechanism chamber and the pre-charge chamber.

In a second aspect, the invention may broadly be said to consist in a line delivery apparatus, comprising a barrel adapted to receive and to expel a projectile, and a pre-charge chamber capable of containing a pressurised gas which can be vented into the interior of the barrel via a valve, wherein a tethering means is provided within the barrel, to which one end of a line, which can be delivered by the projectile, can be tethered.

The inventive step is the provision of a pre-charge container so that the gas from a pressurised gas cartridge can be released into this chamber without the cartridge freezing as might occur if the gas was discharged directly from the cartridge into the barrel to directly propel the projectile.

This pre-charge chamber can be the interior of a hollow handle or some other chamber connected to the valve, or can be a chamber within part of the barrel.

Preferably the apparatus further includes a projectile.

Preferably the projectile is adapted to receive a quantity of line and is able to allow the line to depart from the projectile while in flight.

The line can be received by the projectile in a number of ways, for example by winding the line about the body of the projectile; however, preferably the projectile is adapted to receive the line within its body.

Preferably the valve is adapted to use the pressure exerted by the pressurised gas to assist the opening of the valve after an initial triggering of the valve.

In a further aspect, the invention may broadly be said to consist a line delivery apparatus, comprising a barrel adapted to receive and expel a projectile, and inner and outer chambers capable of containing pressurised gas, a tethering means is provided within the barrel, to which one end of a line, which can be delivered by the projectile can be tethered, wherein, the projectile is released from the barrel as the result of pressure differential between said inner and outer chambers.

In a further aspect, the invention may broadly be said to consist in a line launcher kit comprising at least one line delivery apparatus substantially as specified herein and at least one projectile adapted for use with the apparatus.

Preferably the kit further includes a quantity of line suitable for use with the apparatus.

Preferably the kit further includes at least one pressurised gas cartridge.

In a further aspect, the invention may broadly be said to consist in a method of delivering a line including the steps of;

securing one end of the line to a projectile, securing the other end of the line to a line delivery apparatus substantially as specified herein, filling a pre-charge chamber or the inner and outer chambers of the apparatus with compressed gas, inserting the projectile into the barrel of the line delivery apparatus, releasing the gas from the pre-charge chamber or outer chamber into the barrel to expel the projectile from the barrel, and allowing the line to be extracted from the projectile as it travels away from the line delivery apparatus.

Preferably the method further includes a step of storing the line within or about the projectile prior to expelling the projectile from the barrel.

DESCRIPTION

The invention may also broadly be said to consist in the parts, elements and features referred to or indicated in the specification of the application, individually or collectively, and any or all combinations of any two or more of the parts, elements or features, and where specific integers are mentioned herein which have known equivalents, such equivalents are incorporated herein as if they were individually set forth.

Figure 2:
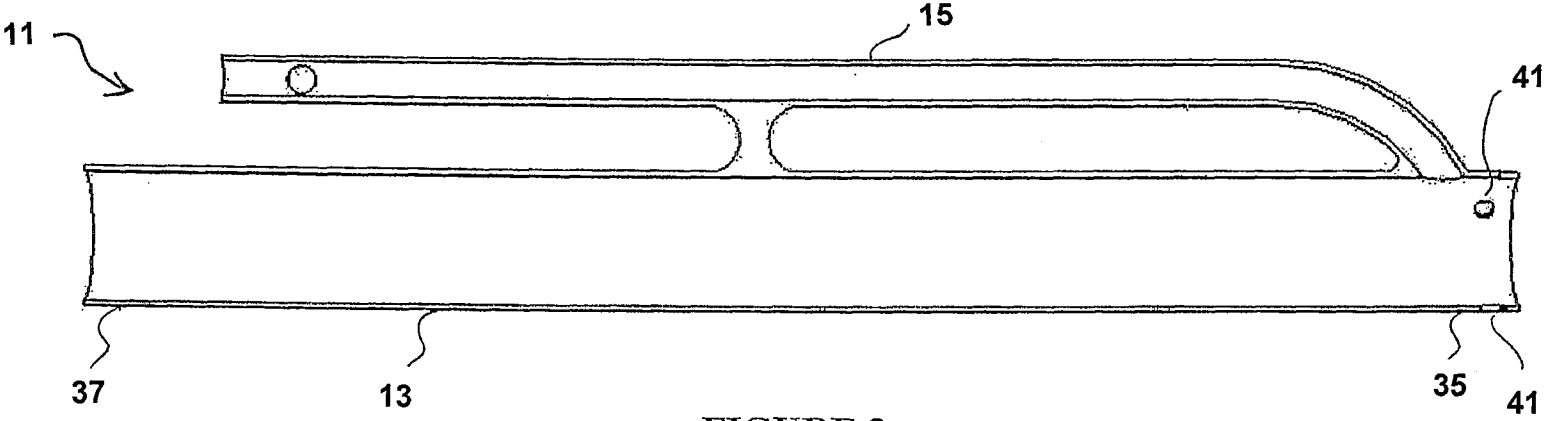
Figure 4:
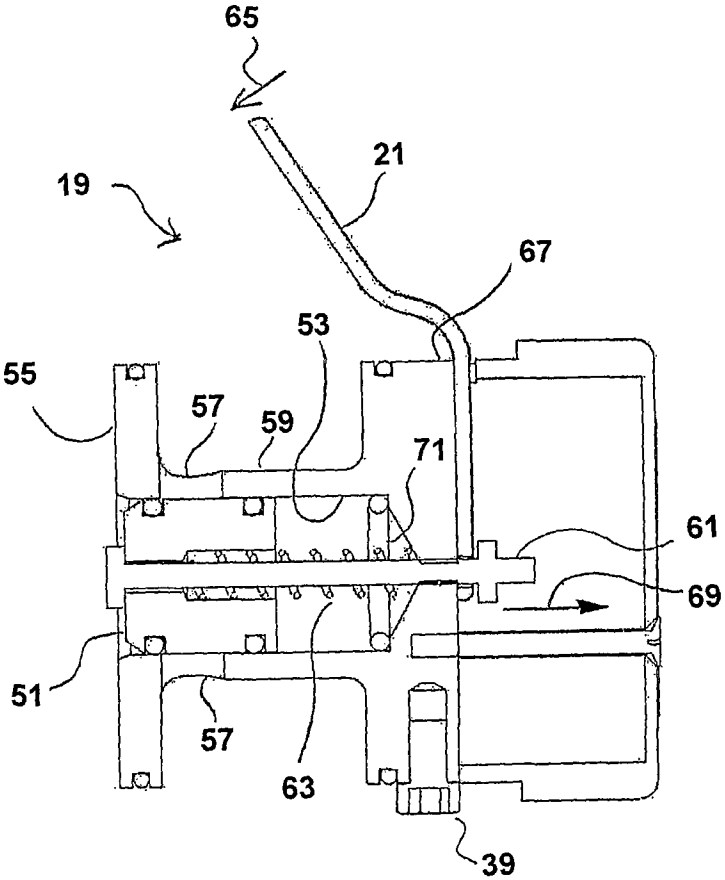
Figure 3:
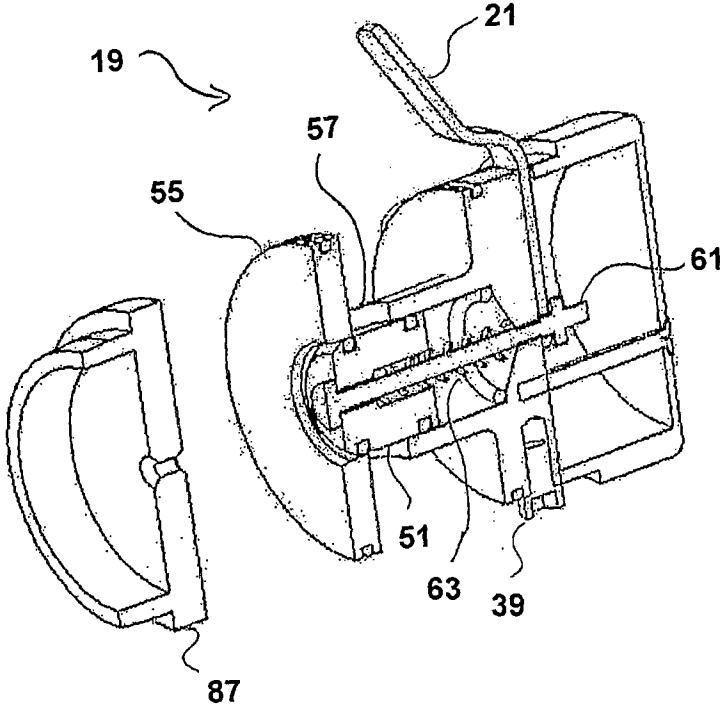
Figure 6:
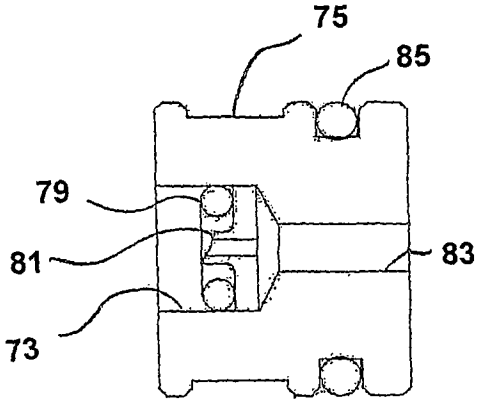
Figure 5:
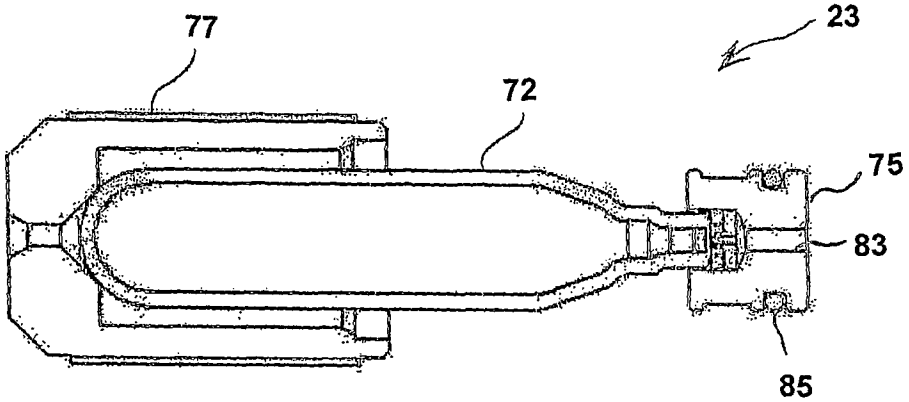
Figure 7:
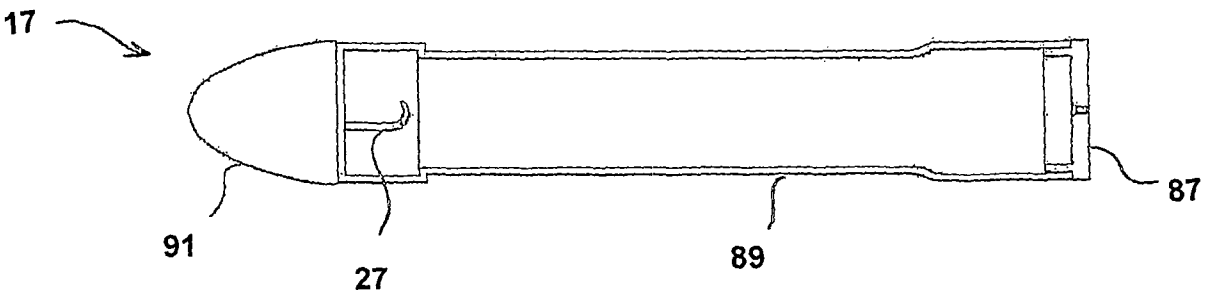
Figure 8:
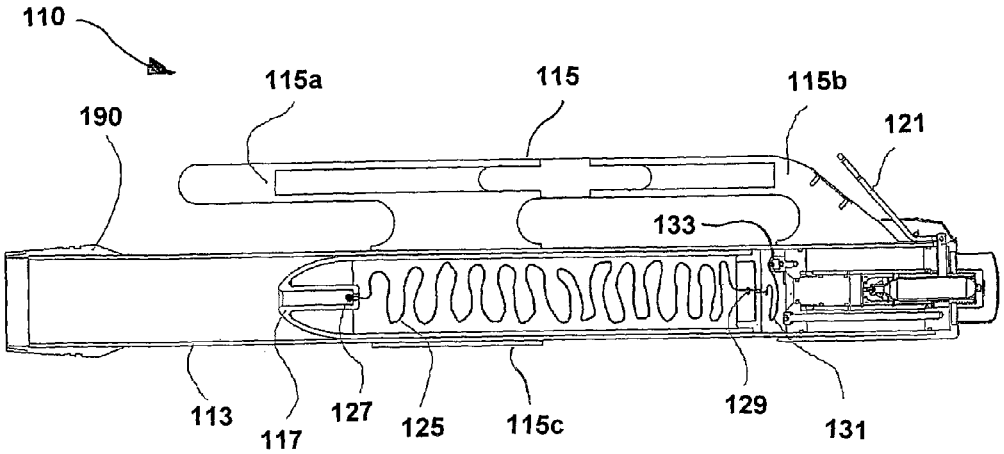
Figure 9:
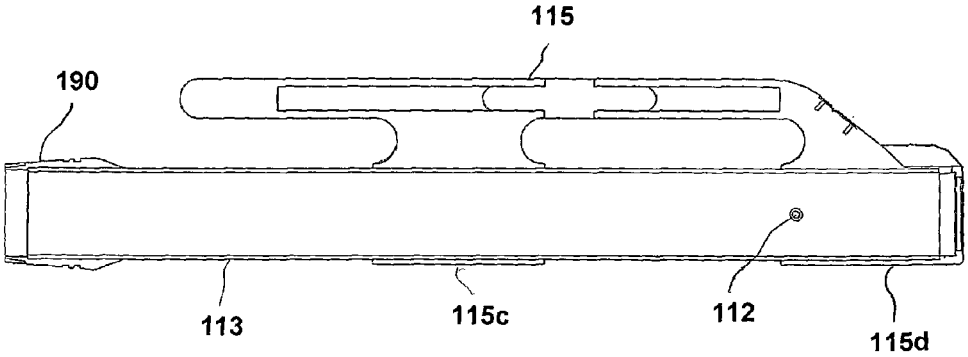
Figure 10:
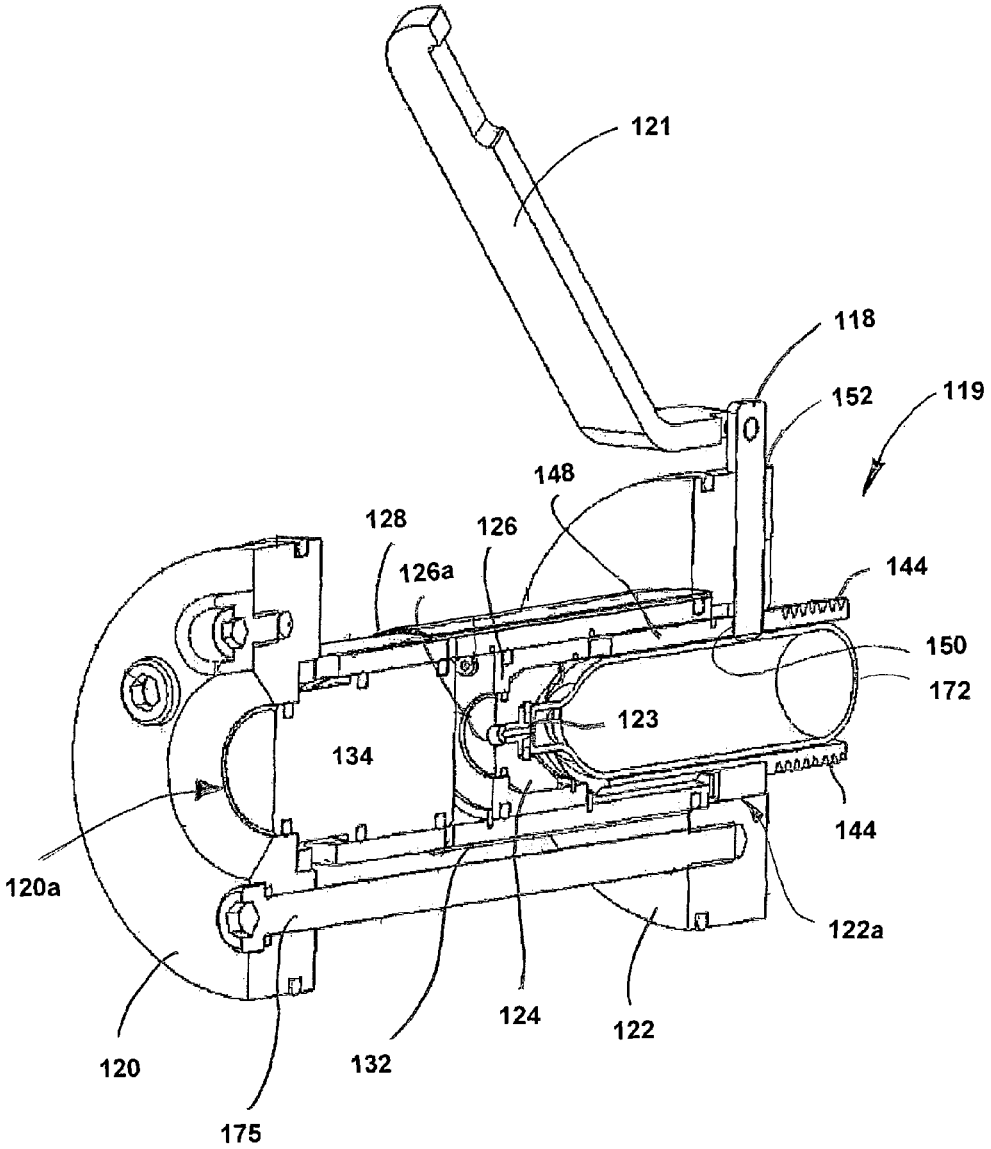
Figure 11:
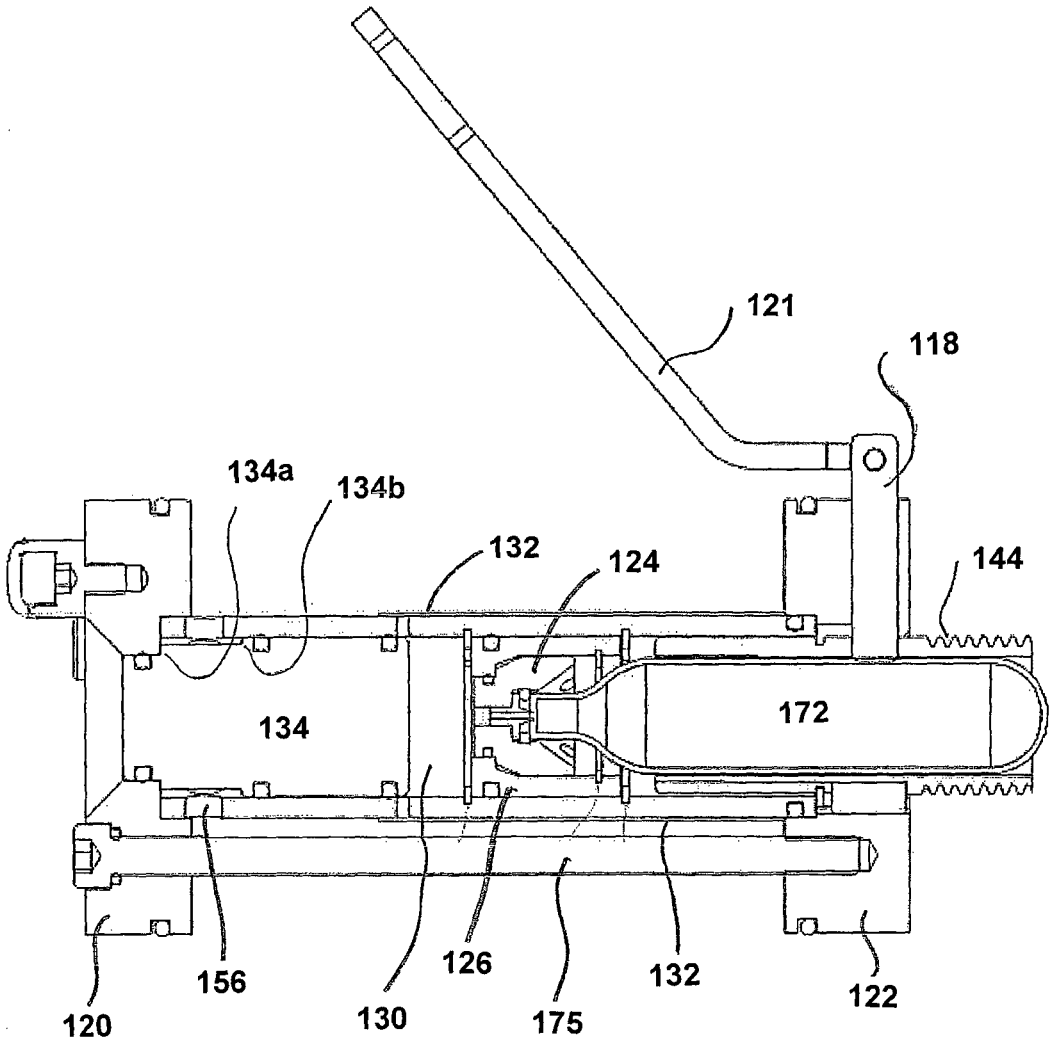
Figure 12:
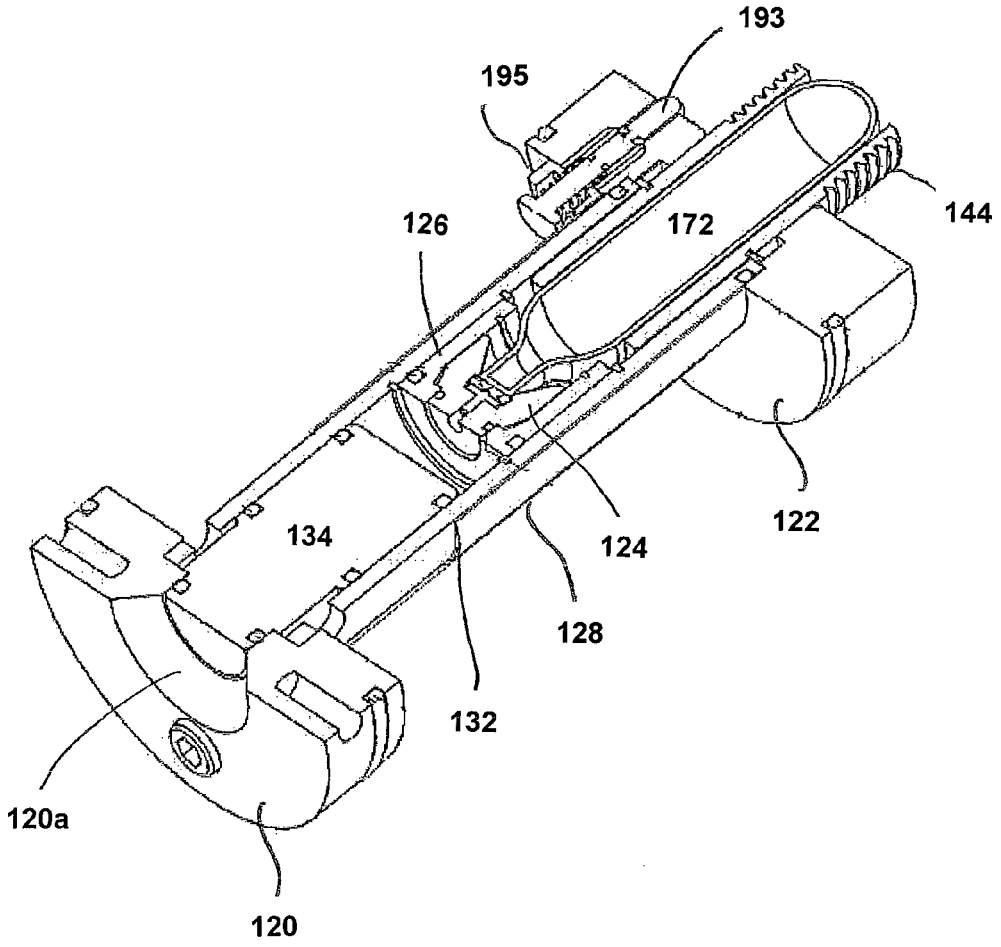
Figure 13:
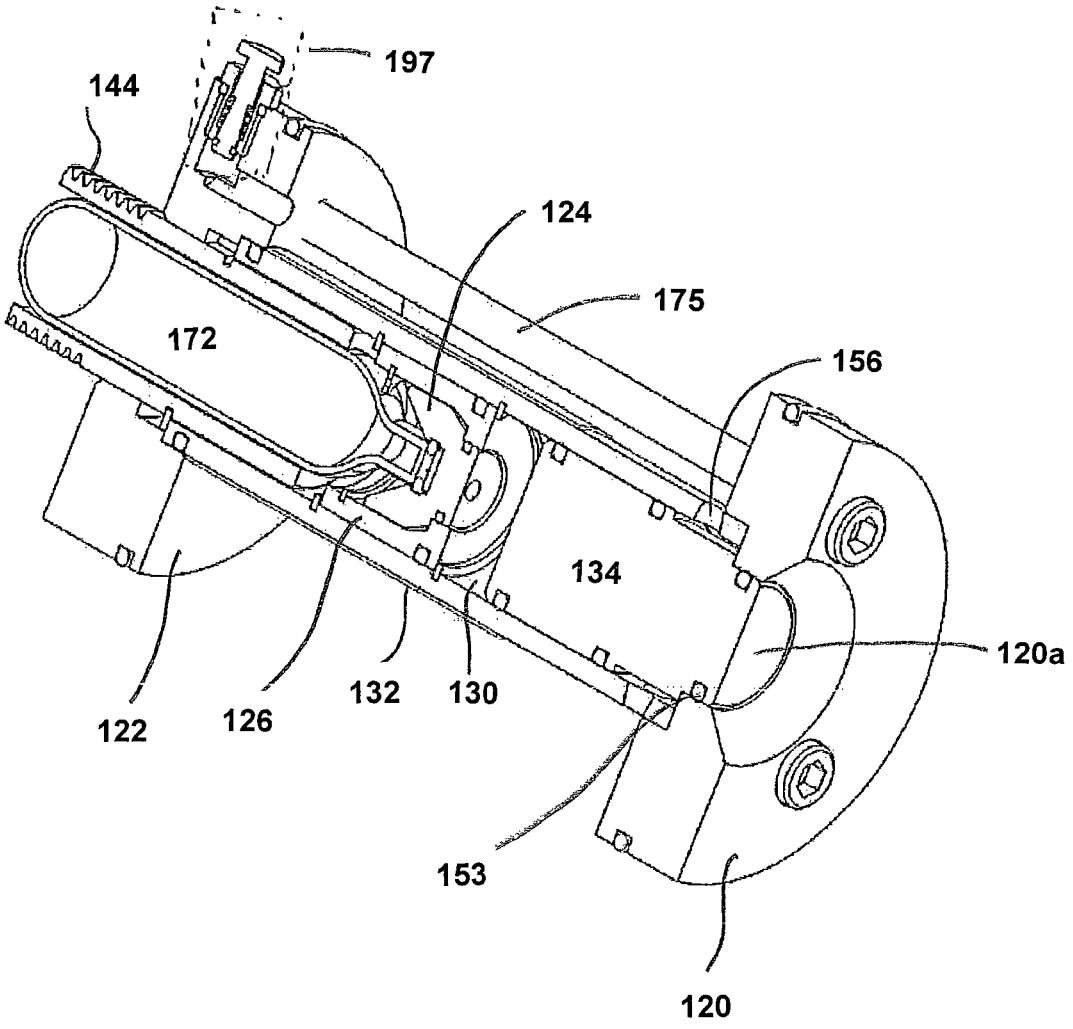
Figure 14:
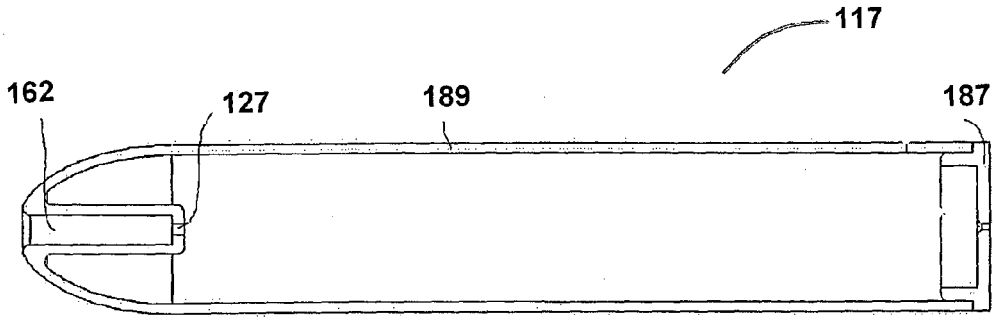
Figure 15:
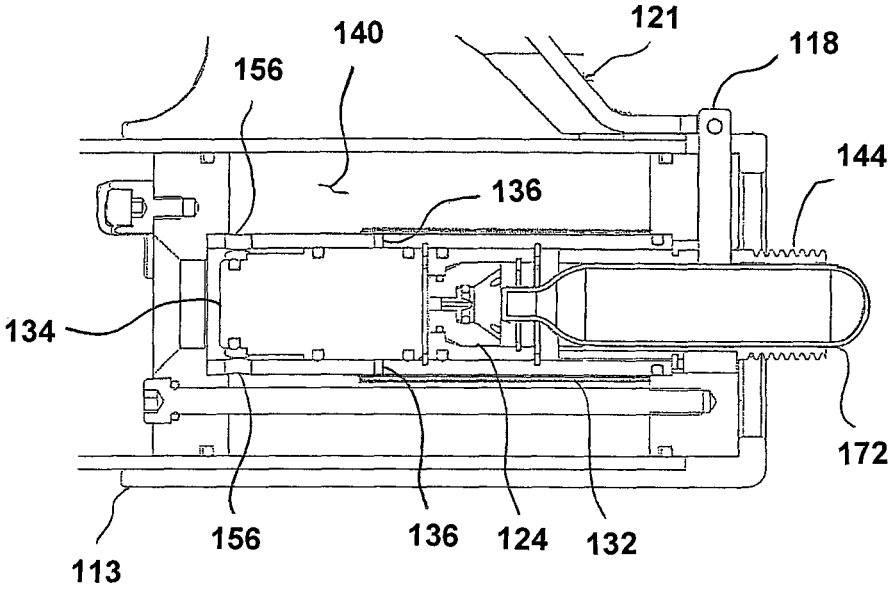
Figure 15:
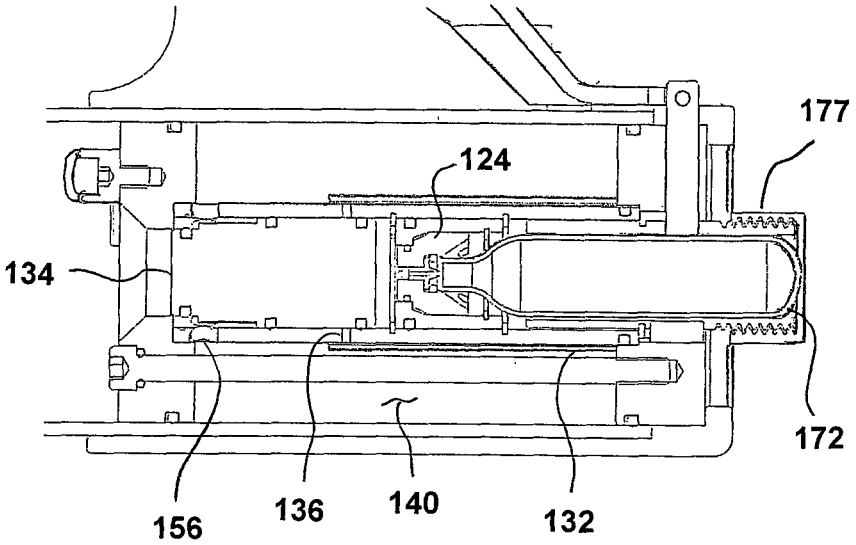
Figure 15:
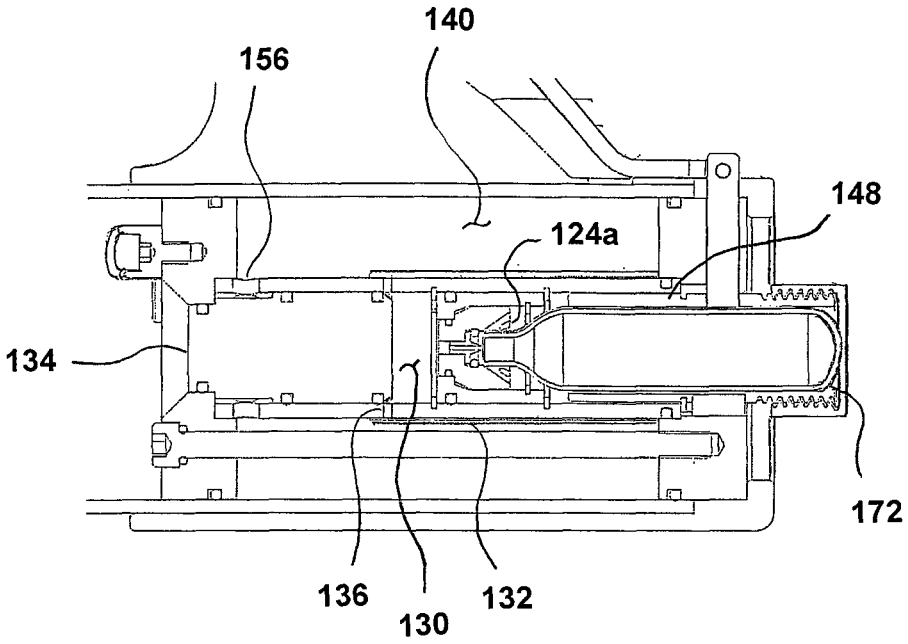
Figure 15:
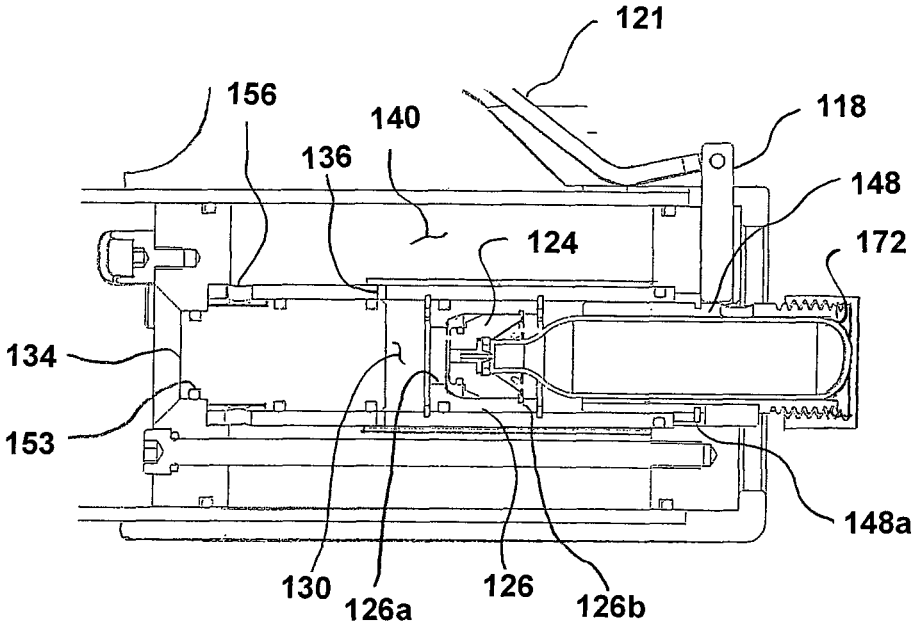
Figure 15:
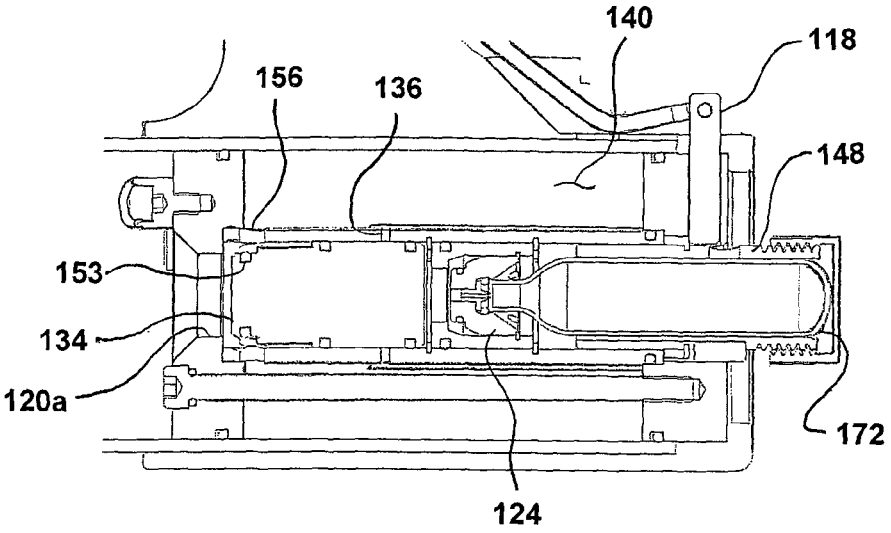

Further aspects of the present invention will become apparent from the following description which is given by way of example only and with reference to the accompanying drawings in which:

FIG. 1 is a cross sectional view of a line delivery apparatus of the first preferred embodiment of the invention, FIG. 2 is cutaway perspective view of the barrel and of the line delivery apparatus of FIG. 1, FIG. 3 is a cross sectional perspective view showing a triggering mechanism for the line delivery apparatus of FIG. 1, FIG. 4 is a cross sectional view of the triggering mechanism for the line delivery apparatus of FIG. 1, FIG. 5 is a cross sectional view of a pressurised cartridge piercing mechanism for the line delivery apparatus of FIG. 1, FIG. 6 is a cross sectional view of a component of the cartridge piercing mechanism for the line delivery apparatus of FIG. 1, FIG. 7 is a cross sectional view of a projectile suitable for use with the apparatus of FIG. 1, FIG. 8 is a cross sectional view of a line delivery apparatus of the second preferred embodiment of the invention, FIG. 9 is cutaway perspective view of the barrel and of the line delivery apparatus of FIG. 8, FIG. 10 is a cross sectional perspective view showing a firing mechanism for the line delivery apparatus of FIG. 8, FIG. 11 is a cross sectional view of the firing mechanism for the line delivery apparatus of FIG. 8, FIG. 12 is a cross sectional view of a pressurised cartridge piercing mechanism for the line delivery apparatus of FIG. 8, FIG. 13 is a cross sectional view of a component of the cartridge piercing mechanism for the line delivery apparatus of FIG. 8, FIG. 14 is a cross sectional view of a projectile suitable for use with the apparatus of FIG. 8, and FIGS. 15(*a*)-(*e*) are the cross sectional views of the pressure firing system under operation for the line delivery apparatus of FIG. 8.

Example 1

With reference to FIGS. 1 and 2, a line delivery apparatus (10) in accordance with the first preferred embodiment of the invention is shown comprising a main housing (11) which in turn comprises a barrel (13) and a pre-charge chamber (15). A projectile (17) is shown fitted within the barrel (13) approximately in the location it would be prior to launching the projectile (17) from the barrel (13). The projectile (17) is explained in further detail with reference to FIG. 7 below.

The apparatus (10) further comprises a triggering mechanism (19) which in this example can be operated manually by a lever style trigger (21). This triggering mechanism is explained in further detail with reference to FIGS. 3 and 4 below.

Also included in the apparatus (10) is a cartridge loading and piercing device (23) which is explained in further detail with reference to FIGS. 5 and 6 below. This device (23) is adapted to receive a pressurised and/or liquefied gas cartridge, for example, a miniature CO2 cartridge commonly referred to as a "sparklet". Clearly a range of alternative compressed gas supplies could be used.

In the example shown, a primary line (25) which is made of a suitable light rope or cord is stored within the body of the projectile (17). The primary line (25) can be made from a range of light ropes or cords. The inventors have trialled the device using a lightweight but very strong cord known as "spectra" which is about 2 millimeters (mm) in diameter and is capable of supporting a 250 kilogram (kg) load. This primary line (25) is connected at one end to a first fitting (27) which forms part of the projectile (17) and can be connected by a knot or connecting device (29) to a tethered section of line (31). The tethered section of line (31) is secured at its other end to a hole or second fitting (33) which in this example is attached to part of the structure of the triggering mechanism (19).

It can be seen in FIG. 2 that the main housing (11) comprises a barrel (13) and a pre-charge chamber (15) and one end of the pre-charge chamber (15) is open to a first end (35) of the barrel (13). The triggering mechanism (19) is located within the first end (35) of the barrel (13) and can control the flow of a compressed gas from the pre-charge chamber (15) into the barrel (13). The projectile (17) is able to exit out of a second end (37) of the barrel. The triggering mechanism is held within the main housing (11) using machine screws (39) which are fitted through holes (41) in the main housing (11).

In the example shown the barrel (13) is approximately 70 mm in diameter and approximately 600 mm in length, and the pre-charge chamber (15) is made from a tube of approximately 25 mm in diameter and has a length slightly less than the barrel. Preferably the main housing (11) is made from an aluminium alloy as this has a suitable strength to weight ratio, however a range of metals, or alloys or plastics materials could be used for the construction of the housing (11).

With reference to FIGS. 3 and 4, the triggering mechanism (19) is described in further detail. The triggering mechanism (19) comprises a plug (51) which is able to reciprocate within a main bore (53) of a valve body (55). In the configuration shown, the plug (51) prevents the transfer of gas through a series of radial ports (57) which are situated in a tubular section (59) of the valve body (55). The plug (51) can move along the main bore (53) in a direction shown by arrow (69) to open the radial ports (57) and allow a transfer of gas from the pre-charge chamber (15) and into the barrel (13).

The plug (51) is held in the location shown by a spindle (61), and by the action of a compression spring (63). When the lever style trigger (21) is moved in the direction shown by the arrow (65) the trigger (21) pivots about the shoulder (67) of the valve body (55) and pushes the spindle (61) in the direction shown by arrow (69). This causes the plug (51) to move along the main bore (53) against the action of the spring (63) and allows the ports (57) to begin to open. As the ports (57) begin to open pressure from the pre-charge chamber can pass into the barrel (13). The rise in pressure in the barrel (13) produces an additional force on the plug (51) which causes it to move rapidly in the direction shown by the arrow (69). When this happens, the movement of the plug (51) can be so fast that an O ring (71) is required to cushion the plug (51) as it is stops when it reaches the closed end of the bore (53).

When the plug (51) is completely clear of the ports (57) gas is able to transfer rapidly into the barrel (13). In this example the ports are each about 13 millimeters in diameter and there are six of them equally spaced about the circumference of the tubular section (59) of the valve body (55). The shape of the valve body (55), that is, the waisted section in the region of the tubular section (59) allows gas to flow from the pre-charge chamber (15) and to each of the ports (57) with minimal restriction.

The fitting (33) referred to with reference to FIG. 1 above is fitted to the valve body (55) but is not shown in FIGS. 3 and 4.

Also shown in FIG. 3 is a rear bulkhead or plug (87), which forms part of the projectile (17), and is explained further with reference to FIG. 7 below.

With reference to FIGS. 5 and 6, the cartridge loading and piercing device (23) is described in further detail. Not shown in these figures is the end of the pre-charge chamber (15) to which the device is fitted and which forms part of the device—refer to FIG. 1 above to see how the items of the cartridge loading and piercing device (23) are fitted within and/or about the pre-charge chamber (15).

The cartridge loading and piercing device (23) shown is adapted for use with "sparklet" style CO2 cartridges which have a pierce-able closure at a neck end of the cartridge. The neck end of such a cartridge (72) can initially be inserted part way into a bore (73) of a socket member (75).

A cap (77) which has an internal thread, and which is adapted to mate with a corresponding external thread on the free end of the pre-charge chamber (15), is configured such that it will push the cartridge (72) further into the bore (73) as the cap (77) is screwed onto the pre-charge chamber (15). Continued screwing of the cap (77) onto the pre-charge chamber (15) causes the neck end of the cartridge (77) to initially contact an O-ring (79) and then a piercing device (81). Further screwing of the cap (77) causes the piercing device (81) to pierce, the cartridge (72) allowing the contents of the cartridge (72) to be discharged into the pre-charge chamber (15) through a passage (83).

The socket member (75) can be held in place in the tubular pre-charge chamber (15) with a grub screw or similar device, and is provided with an external O-ring (85) to ensure that a positive seal is made with the internal diameter of the pre-charge chamber (15).

It is envisaged that many alternative cartridge loading and piercing devices could be employed, for example a cap (77) which mates with the pre-charge chamber (15) using a bayonet type fitting in place of the screw thread mentioned above.

With reference to FIG. 7, the projectile (17) is described in further detail. The projectile (17) includes a rear bulkhead or plug (87), a hollow tubular body (89) and a nose fitting (91). The nose fitting (91) is aerodynamic in shape and is preferably made from a rubberised material in the interests of safety when the apparatus (10) is used. The hollow tubular body (89) is designed to house the primary line (25) and the first fitting (27), to which the line (25) can be tethered, is located in the forward end of the body (89).

The body (89) and/or the plug (87) have an outside diameter that is close to the internal diameter of the barrel (13).

The basic operation of the apparatus (10) will now be explained.

As noted above, the pre-charge chamber (15) can be charged with a pressurised gas from the compressed gas cartridge (72). Trials show that by using a single "sparklet" style cartridge the pre-charge chamber (15) can be charged to approximately 20 Bar. The gas is cold when it initially exits the gas cartridge (72) but the gas quickly warms up as it absorbs heat from the walls of the pre-charge chamber (15) and this helps to improve the pressure available.

If the apparatus (10) is assembled as shown in FIG. 1, and the pre-charge chamber is charged, the projectile (17) can be ejected from the barrel (13) by simply operating the trigger (21). As noted with reference to FIGS. 3 and 4 above, when the trigger is moved, the plug (51) moves rapidly away from the ports (57) allowing the compressed gas from the pre-charge chamber (15) to rapidly enter the barrel (13).

The rapidly entering gas propels the projectile (17) out of the barrel at a relatively high velocity. The tethered section of line (31) is typically only about a meter long and will soon become taut. This will cause the plug (87) to be pulled out of the body (89) of the projectile (17) as the projectile continues to move through the air. Now the primary line (25) is able to freely exit out of the body (89) during the remainder of the flight of the projectile (17).

Initial testing of the apparatus indicates that the projectile (17) can be propelled approximately 35 to 50 meters. The primary line (25) is simply laid out as the projectile (17) flies through its trajectory meaning that the line produces little interference to the flight of the projectile (17).

Initial testing has also shown that when assembling the projectile in preparation for use, it may be advantageous to simply stuff the primary line (25) into the body (89) of the projectile, beginning of course with the end of the line that is tethered to the first fitting (27). It would appear that by simply stuffing the line in, rather than carefully winding it into a coil, there is a reduced chance that the line will tangle as it is laid out by the projectile (17) while in flight. This is perhaps because the line (25) is not twisted as it is simply stuffed into the body (89).

Example 2

With reference to FIGS. 8 and 9, a line delivery apparatus (110) of the second preferred embodiment is shown which has been developed for simpler manufacture.

The apparatus (110) comprises a barrel (113) and handle (115) having a front section (115*a*) and back section (115*b*). The barrel (113) is of a hollow tubular shape. The barrel (113) is preferably made out of anodised marine grade aluminium and the handle (115) is preferably made out of a plastics material, for example a glass reinforced polypropylene plastic which is aesthetically pleasing and which is relatively tough. Use of such materials minimises corrosion/rusting which is advantageous since the apparatus (11) is commonly used in a salt water environment. Such materials also have a suitable strength to weight ratio. However, other suitable materials, for example other alloys or plastics materials could be used to make the handle and/or barrel.

In this preferred embodiment, a first annular sleeve (115*c*) and a second annular sleeve (115*d*) are used to connect the barrel with the handle (115). The first and second annular sleeves (115*c* and 115*d*) have an inside diameter that is substantially equal to the outside diameter of the barrel (113) and are open at both ends. The first annular sleeve (115*c*) is integrally formed with the centre part of the handle (115) and the second annular sleeve (115*d*) is integrally formed at the back section (115*b*) of the handle (115). The barrel (113) is snugly fitted inside the first and second sleeves (115*c* and 115*d*) as shown in FIG. 9.

The barrel (113) includes two fastener holes (112), and a barrel protector (190) that is preferably made out of a resilient material, for e.g. rubber. The barrel protector (190) is located at the front end or open end of the barrel (113) for protecting any accidental damage of the barrel (113) upon any impact.

The triggering mechanism or firing mechanism (119), which is housed substantially towards the end of the barrel (113), will now be explained in detail with reference to FIGS. 10-13.

The firing mechanism (119) includes a bobbin shaped member which comprises a first disc (120) having a first orifice or outlet port (120*a*) at a forward end of the firing mechanism (119), and a second disc (122) having a second orifice (122*a*) at an aft end. A hollow tube (128) having an outside diameter that is substantially the same as the diameter of the orifices (120*a* and 122*a*) of the first and second discs (120 and 122) extends between the first disc (120) and the second disc (122).

The outer diameter of both the first disc (120) and the second disc (122) is substantially equal to the inside diameter of the barrel (113) and hence, the first and second discs (120 and 122) fit snugly within the interior of the barrel (113). The firing mechanism (119) is held within the barrel (113) using machine screws which are fitted through the fastener holes (112) in the barrel (113).

As shown in FIG. 10, the second disc (122) includes a hole (152) that extends radially from the outer circumference of the second disc (122) to the second orifice (122*a*).

A lever style manually operated trigger (121) is pivotally connected to a firing pin (118), and the firing pin (118) is supported within the hole (152). Movement of the trigger (121) causes the firing pin (118) to move longitudinally within the hole (152).

A charging means of the apparatus includes a tubular insert (148) which is situated within the tube (128). The outside diameter of the insert (148) is slightly smaller than the inside diameter of the tube (128) so that the insert (148) is slidably received inside the tube (128). In fact, only about half of the total length of the insert (148) is slidably fitted inside the tube (128). The protruding part of the insert (148) has an external thread (144) that is adapted to engage with the internal thread of a knob or cap (177) (refer to FIG. 15(*b*)). The insert (148) includes a recess or hole (150) that is configured to engage with the firing pin (118).

The insert (148) of the charging means houses a miniature CO2 cylinder, or "sparklet" as they are known, which holds CO2 in a pressurised liquid form. When the firing pin (118) is engaged with the hole (150) the tube (128) is held securely, and when the firing pin (118) is removed from the hole (150) the tube (128), i.e. when the trigger (121) is moved, the tube (128) is able to move.

A substantially tubular shaped collar (126) having outside diameter that is substantially the same as the inside diameter of the tube (128) is snugly fitted inside the tube (128) of the firing mechanism. As can be seen in FIGS. 10-13, the length of the collar (126) is shorter than the length of the tube (128). Since the collar (126) is of substantially tubular shape, the collar (126) has a first outlet orifice (126*a*) at a forward end and a second and larger outlet orifice at an aft end.

The charging means also includes a second shuttle (124) which has an outer diameter that is substantially same as the inside diameter of the tubular shaped collar (126) is slidably fitted inside the collar (126). The first end of the second shuttle (124) has a reduced outside diameter than the outside diameter of the body of the second shuttle (124) and acts as a plug to the first outlet orifice (126*a*) which is defined by the collar (126). As shown in the accompanying figures, the length of the second shuttle (124) is shorter than the length of the collar (126) and the inside diameter of the collar (126) is such that it tapers towards its forwards end.

A cartridge piercing device (123) is situated within the second shuttle (124). The cartridge piercing device (123) pierces the cap of the pressurised gas cartridge (172), when the cartridge is loaded into the tubular insert (148) and the cap (177) is screwed onto the tubular insert (148).

A first shuttle or valve member (134) is slidably fitted inside the forward end of the tube (128) as shown in the accompanying figures. The outside diameter of the main body of the first shuttle (134) is substantially same as the inner diameter of the tube (128). A forward end of the first shuttle (134) has a reduced outside diameter compared to the main body section of the first shuttle (134) and forms a plug section which is configured to block the first orifice or outlet port (120*a*) of the firing mechanism (119). A first shoulder (134*a*) marks a transition between the plug section and an intermediate section of the first shuttle (134). The intermediate section has a diameter which is between that of the plug section and the main body of the first shuttle (134). A second shoulder (134*b*) marks the transition between the intermediate and the main body section of the first shuttle (134). The plug section is preferably surrounded by an o-ring (153) as shown in FIG. 14. This first shuttle (134) is preferably made out of a light weight material such as nylon or other plastics material.

An inner pressure chamber or trigger mechanism chamber (130) is defined inside the tube (128) and between the forward end of the collar (126) and the aft end of the first shuttle (134). The inner pressure chamber (130) has a cylindrical shape.

An outer pressure chamber or pre-charge chamber (140) is the space that is defined between the outer surface of the tube (128), the inner surface of the barrel (113), the aft surface of the first disc (120) and the forward surface of the second disc (122). Thus, the outer pressure chamber or pre-charge chamber (140) is of an annular hollow cylindrical shape.

The tube (128) has at least one inlet hole or port (136) and at least one transfer port (156) along its length. A covering sleeve (132) of resilient material such as rubber covers the part of the exterior surface of the tube (128) that contains the inlet holes (136). The rubber sleeve (132) acts as a one way valve which allows gas to flow from the inner pressure chamber (130) and into the outer pressure chamber (140) via the inlet holes (136), but not to flow back the opposite way.

The first and second discs (120 and 122) are connected to each other using long connecting bolts (175) as shown in the accompanying drawings.

With reference to FIGS. 8 and 14, the projectile (117) is described in further detail. The projectile (117) includes a rear bulkhead or plug (187) and a hollow tubular body (189). The forward end of the projectile (117) is aerodynamic in shape and is preferably made from a resilient material such as a rubber in the interests of safety when the apparatus (110) is used. The hollow tubular body (189) is designed to house a primary line (125), and the first fitting (127), to which the line (125) can be tethered, is located in the forward end of the body (189). The forward end preferably comprises a glow stick insertion hole (162) to facilitate the insertion of glow stick or similar object so that the projectile (117) is visible when used during night time or in darkness. Alternatively, the forward end of the projectile (117) can have a thermo-luminescent head that is built into the projectile (117).

The body (189) and/or the plug (187) have an outside diameter that is less than but close to the internal diameter of the barrel (113).

In the example shown, the primary line (125) which is made of a suitable light rope or cord is stored within the body of the projectile (117). The primary line (125) can be made from a range of light ropes or cords. The inventors have trialled the device using a lightweight but very strong cord known as "spectra" which is about 2 millimeters (mm) in diameter and is capable of supporting a 250 kilogram (kg) load. This primary line (125) is connected at one end to a first fitting (127) which forms part of the projectile (117) and can be connected by a knot such as projectile cap line release knot (129) to a tethered section of line (131) such as lanyard line. The tethered section of line (131) is secured at its other end to a hole or second fitting (133) which in this example is attached to part of the structure of the firing mechanism (119).

The projectile is adapted to fit adjacent the firing mechanism (119) of the apparatus (110).

The basic operation of the apparatus (110) will now be explained with reference to FIGS. 15(*a*)-(*e*).

Firstly, a projectile (117) is prepared and the primary line (125) is connected to the tethered section of line (131), and the projectile is inserted into the barrel (113).

Then, to charge the apparatus (110) ready for operation, a new cartridge such as a CO2 sparklet cartridge (172) having a pierce-able closure at the neck end, is inserted inside the apparatus (110) through the second orifice (122*a*) of the apparatus (110) as shown in FIG. 15 (*a*).

As shown in FIG. 15 (*b*), the screw knob (177) having internal thread is screwed on so that it engages with the external thread (144) of the insert. Further screwing of the knob pushes the cartridge (172) into contact with the piercing end of the cartridge piercing device (123). A pierce-able closure is punctured at the neck end of the cartridge (172) thereby allowing the cartridge (172) to expel its fluid contents into the inner pressure chamber (130).

The build up of pressure in the inner pressure chamber (130) forces the first shuttle (134) to move forward as shown in FIG. 15 (*c*), so that the plug section of the first shuttle (134) closes off the first orifice (120*a*), thereby sealing the outer pressure chamber (122). The position of the first shuttle (134) as shown in this figure is referred to herein as the first position of the first shuttle (134). As can be seen in the figure, when the first shuttle (134) is in the first position the inlet holes (136) are uncovered which allows gases to transfer from the inner pressure chamber (130) and into the outer pressure chamber (140) via the one way valve. This allows the outer pressure chamber (140) to become pressurized. As noted earlier, the rubber sleeve (132) prevents the gases transferring from the outer pressure chamber (140) and back into the inner pressure chamber (130).

The line delivery apparatus (110) is now charged and ready to be used. When the line delivery apparatus (110) is to be used to deliver a line, for example during a rescue operation, the lever style trigger (121) is pressed. Movement of the trigger (121) levers the firing pin (118) upwards as shown in FIG. 15 (*d*), thus allowing the second shuttle (124), the insert (148) and the cartridge (172), to be forced backwards by the pressure in the inner pressure chamber (130). When the second shuttle (124) moves aft, the first outlet orifice (126*a*) of the collar (126) becomes open. Gases within the inner pressure chamber (130) can now escape through the first outlet orifice (126*a*) and through a series of longitudinal holes (124*a*) (see FIG. 15*c*) in the second shuttle (124).

This allows the pressure in the inner pressure chamber (130) to drop as the gases escape out of it. The insert (148) and second shuttle (124) are only allowed to travel a few millimeters upon firing. Their travel is limited by the use of retaining rings (126*b*) and (148*a*).

The pressure in the outer pressure chamber (140) is maintained by the covering sleeve (132) which acts a one way valve by preventing the pressure to enter the inner chamber (130) via the inlet holes (136).

The pressure in the outer pressure chamber (140) is now much greater than the pressure in the inner pressure chamber (130). The pressure in the outer pressure chamber (140) communicates with the second shoulder (134*b*) on the first shuttle (134) via the outlet holes (156). The force acting on the second shoulder (134*b*) now exceeds the opposing force acting on the aft face of the first shuttle (134), and therefore the first shuttle (134) is moved in an aft direction. When the first shuttle (134) is moved fully aft as shown in FIG. 15 (*e*), the plug section and the o-ring (153) at the first end of the first shuttle (134) no longer closes the first orifice (120*a*). The position of the first shuttle (134) as shown in this figure is referred to herein as the second position of the first shuttle (134).

When the first shuttle (134) is moved to the second position as shown in FIG. 15 (*e*), the high pressure gases in the outer pressure chamber (140) can exit rapidly though the transfer ports (156) and the first orifice or outlet port (120*a*) and into the closed end of the barrel (113). This rapid release of high pressure gases into the barrel (113) propels the projectile (117) out of the barrel (113) at a relatively high velocity.

Soon after the projectile (117) leaves the barrel (113), the tethered section of line (131) becomes taut. This causes the plug (187) to be pulled out of the body (189) of the projectile (117) as the projectile continues to move through the air.

Now the primary line (125) is able to freely exit out of the body (189) during the remainder of the flight of the projectile (117).

The primary line (125) is simply laid out as the projectile (117) flies through its trajectory meaning that the line produces little interference to the flight of the projectile (117).

Hence, the projectile (117) can be ejected from the barrel (113) by simply operating the lever style trigger (121).

Initial testing has also shown that when assembling the projectile (177) in preparation for use, it may be advantageous to simply stuff the primary line (125) into the body (189) of the projectile, beginning of course with the end of the line that is tethered to the first fitting (127). It would appear that by simply stuffing the line in, rather than carefully winding it into a coil, there is a reduced chance that the line will tangle as it is laid out by the projectile (117) while in flight. This is perhaps because the line (125) is not twisted as it is simply stuffed into the body (189).

Even though the primary line (125) is shown installed within the projectile (117), however the line (125) could be carried externally, for example by winding the line (125) about the body (189) of the projectile (117), or by placing it in a separate storage bag or container, external to the barrel (113) of the launcher apparatus (110).

The apparatus (110) includes a number of safety features. A safety pin can be inserted into a hole in the handle (115) to prevent inadvertent movement of the trigger lever (121).

The apparatus (110) also has a safety locking pin system (195) located in the second disc (122). The safety locking pin system (195) includes a spring loaded locking pin (193) as shown in FIG. 12. When the apparatus (110) is pressurised, the pressure within the outer pressure chamber (140) moves the locking pin (193) against the force of the spring, so that the pin extends aft of the aft face of the second disc (122). The extended pin (193) prevents rotation of knob (177), and thereby prevents inadvertent removal of the CO2 cartridge (172) while the firing mechanism is pressurised. This helps to prevent accidental firing when the apparatus (110) is loaded by removal of the cartridge (172).

A relief valve (197) is provided for use when it is necessary to depressurise the apparatus (110) once armed. The relief valve (197) is in communication with the outer pressure chamber (140), as shown in FIG. 13, and can be used to vent the pressurised gases to atmosphere. Depressing the pin of the relief valve (197) allows the gases to escape.

An alignment pin can be used to make sure the insert (148) does not turn and that hole for receiving the firing pin (118) always lines up with the firing pin (118).

As explained above, firing of the apparatus is achieved by removing the firing pin (118) from the hole in the insert (148), allowing the forces to open the second shuttle (124) and dump the centre chamber's (120) pressure.

VARIATIONS

The apparatus (10 or 110) described herein uses gas from canister to fill the pre-charge chamber (15) or the inner and outer pressure chambers (130, 140), but clearly this could be achieved by a number of different methods, for example by using a battery operated compressor. Similarly larger cartridges, or multiple cartridges, could be used to increase the capacity of the apparatus, for example if additional projectile range, or additional projectile payload, was required.

While in many applications the apparatus (10 or 110) could be used to deliver a light line which could then be used to pull out a larger line or rope, but in some applications just the light line could be used, for example, during a water rescue. For such purposes, it is also envisaged that the primary line (25 or 125) could be provided with hand-holds, for example loops of fabric tape, to assist a person who is being rescued using the line (25 or 125). Similarly, the projectile (17 or 117) could be configured to carry additional equipment, for example, an inflatable flotation device, to assist with rescue operations.

The projectile (17 or 117) can include a floatation chamber or a floatation device, for example a floatation chamber or device that is deployed when the line becomes taut when the projectile has reached the extent of its travel.

The projectile described in FIGS. 7 and 14 are interchangeable. Several other projectiles with similar features and is compatible to the apparatus (10 or 110) can be used.

The primary line (25 or 125) is shown installed within the projectile (17); however the line (25) could be carried externally, for example by winding the line (25 or 125) about the body (89 or 189) of the projectile (17 or 117).

In an alternative configuration the collar (126) and the tube (128) can be formed as a single part for simplified assembly.

Aspects of the present invention have been described by way of example only and it should be appreciated that modifications and additions may be made thereto without departing from the scope thereof.

DEFINITIONS

Throughout this specification the word "comprise" and variations of that word, such as "comprises" and "comprising", are not intended to exclude other additives, components, integers or steps.

ADVANTAGES

Thus it can be seen that at least the preferred form of the invention provides a line delivery apparatus which does not require the use of any pyrotechnic devices, and which could be relatively inexpensive to produce, to use, and to maintain.

The invention claimed is:

1. A line delivery apparatus comprising:

a barrel configured to receive and to expel a projectile by use of the expansion of a compressed gas, the barrel having an open end and a closed end, a pre-charge chamber having i) one or more inlet ports which communicate with a source of compressed gas, and ii) one or more outlet ports which communicate with the closed end of the barrel, and a gas power assisted triggering mechanism that includes a valve member, a trigger mechanism chamber that holds pressurized gas from the compressed gas source, a shuttle, and a manually operated trigger, wherein the triggering mechanism controls a flow of fluid through the or each outlet port, the triggering mechanism having a valve member which is movable between i) a first position in which the valve member prevents flow through the or each outlet port, and ii) a second position in which the valve member does not prevent flow through the or each outlet port, wherein the valve member is held at the first position by the pressurized gas that is held within the trigger mechanism chamber, and wherein when the manually operated trigger is moved, the shuttle moves and the pressurized gas held within the trigger mechanism chamber is released, and the valve member is then moved from the first position to the second position by the pressure of the fluid within the pre-charge chamber, allowing high pressure gases in the pre-charge chamber to exit through the outlet ports and into the closed end of the barrel.

2. A line delivery apparatus as claimed in claim 1, wherein the source of compressed gas used to charge the pre-charge chamber is a single use pressurized fluid cylinder which can be attached to and from part of the apparatus.

3. A line delivery apparatus as claimed in claim 1, wherein the line delivery apparatus also includes a line which is connectable at one end to the interior of the barrel and at an opposite end to the projectile.

4. A line delivery apparatus as claimed in claim 1, wherein the line delivery apparatus also includes the projectile.

5. A line delivery apparatus as claimed in claim 1, wherein the source of compressed gas used to charge the pre-charge chamber is a single use pressurized fluid cylinder which can be attached to and from part of the apparatus, and wherein the line delivery apparatus includes a piercing device configured to pierce a cap of the pressurized fluid cylinder.

6. A line delivery apparatus as claimed in claim 1, wherein the line delivery apparatus includes a one way valve between the trigger mechanism chamber and the pre-charge chamber.

7. A line delivery apparatus as claimed in claim 2, wherein the line delivery apparatus also includes a line which is connectable at one end to the interior of the barrel and at an opposite end to the projectile.

8. A line delivery apparatus as claimed in claim 2, wherein the line delivery apparatus also includes the projectile.

9. A line delivery apparatus as claimed in claim 3, wherein the line delivery apparatus also includes the projectile.

10. A line delivery apparatus as claimed in claim 5, wherein the piercing device is situated within the shuttle.

11. A line delivery apparatus as claimed in claim 2, wherein the line delivery apparatus includes a piercing device configured to pierce a cap of the pressurized fluid cylinder.

12. A line delivery apparatus as claimed in claim 3, wherein the source of compressed gas used to charge the pre-charge chamber is a single use pressurized fluid cylinder which can be attached to and from part of the apparatus, and wherein the line delivery apparatus includes a piercing device configured to pierce a cap of the pressurized fluid cylinder.

13. A line delivery apparatus as claimed in claim 4, wherein the source of compressed gas used to charge the pre-charge chamber is a single use pressurized fluid cylinder which can be attached to and from part of the apparatus, and wherein the line delivery apparatus includes a piercing device configured to pierce a cap of the pressurized fluid cylinder.

14. A line delivery apparatus as claimed in claim 2, wherein the line delivery apparatus includes a one way valve between the trigger mechanism chamber and the pre-charge chamber.

15. A line delivery apparatus as claimed in claim 3, wherein the line delivery apparatus includes a one way valve between the trigger mechanism chamber and the pre-charge chamber.

16. A line delivery apparatus as claimed in claim 4, wherein the line delivery apparatus includes a one way valve between the trigger mechanism chamber and the pre-charge chamber.

* * * * *